US008590845B2

(12) United States Patent
Freise

(10) Patent No.: US 8,590,845 B2
(45) Date of Patent: Nov. 26, 2013

(54) WHEEL SENSOR

(75) Inventor: Rainer Freise, Braunschweig (DE)

(73) Assignee: Siemens Aktiengesellschaft, Munich (DE)

( * ) Notice: Subject to any disclaimer, the term of this patent is extended or adjusted under 35 U.S.C. 154(b) by 241 days.

(21) Appl. No.: 13/127,844

(22) PCT Filed: Oct. 5, 2009

(86) PCT No.: PCT/EP2009/062913

§ 371 (c)(1),
(2), (4) Date: May 5, 2011

(87) PCT Pub. No.: WO2010/052081

PCT Pub. Date: May 14, 2010

(65) Prior Publication Data

US 2011/0210213 A1 Sep. 1, 2011

(30) Foreign Application Priority Data

Nov. 5, 2008 (DE) ..... 10 2008 056 481

(51) Int. Cl.
*B61L 11/08* (2006.01)
*B61L 13/04* (2006.01)

(52) U.S. Cl.
USPC ..... 246/249; 246/247

(58) Field of Classification Search
USPC ..... 246/246, 247, 249; 324/207.14, 207.15, 324/207.16, 207.22
See application file for complete search history.

(56) References Cited

U.S. PATENT DOCUMENTS 4,283,031 A * 8/1981 Finch ..... 246/128
6,371,417 B1 * 4/2002 Southon ..... 246/247

FOREIGN PATENT DOCUMENTS

DE 19915597 A1 12/1999
DE 10137519 A1 2/2003
EP 1362759 A1 11/2003

OTHER PUBLICATIONS

Frauscher et al: "Wirbelstrombremsfeste Radsensoren",Elektrotechnik und Informationstechnik, 2000, pp. 226-230, XP009066775, Wien, Austria. English abstract.

* cited by examiner

*Primary Examiner* — Zachary Kuhfuss
(74) *Attorney, Agent, or Firm* — Laurence A. Greenberg; Werner H. Stemer; Ralph E. Locher

(57) ABSTRACT

A wheel sensor that is particularly suited for track release signaling systems has at least one sensor device having an AC-fed sensor coil of an electric oscillating circuit sensitive to an inductive interaction of the sensor coil with passing wheels of rail vehicles. A further spool is connected to the sensor coil for suppressing external interference fields in a counter circuit. The further coil is arranged underneath the sensor coil and a spacing distance between the further coil and the sensor coil is at least one third of the inside diameter of the sensor coil.

9 Claims, 1 Drawing Sheet

WHEEL SENSOR

BACKGROUND OF THE INVENTION

Field of the Invention

Wheel sensors which operate on the principle of an inductive proximity switch are widely used in the field of railroad monitoring installations, in particular for track-free signaling installations. Corresponding wheel sensors have at least one sensor coil, which is arranged in an electrical resonant circuit and is fed with alternating current. The mass of iron in a wheel rolling past or in an axle rolling past leads to damping of the magnetic field of the sensor coil, as a result of which it is possible to detect that a wheel has moved past on the basis of a change caused by this in the characteristics of the electrical resonant circuit, for example the oscillation amplitude or the Q-factor.

Inductively operating wheel sensors are normally comparatively sensitive to inductively input interference voltages at the operating frequency, such as those which can be caused by rail currents. By way of example, the return conductor current of a locomotive through the rail, or the harmonic component of this return conductor current, can cause an interference signal in the form of a beat. A beat such as this can normally be distinguished only with difficulty from a signal caused by a wheel moving past, when using inductive wheel sensors. Furthermore, wheel sensors which operate on an inductive principle of operation in practice can also be interfered with, for example, by sensors arranged in their vicinity with the same operating frequency; furthermore, interference can also be caused or induced by high commutation current flanks, which occur in a pulsed form, in the rail current, or by lines and transformers in trains traveling past.

The present application relates to a wheel sensor, in particular for track-free signaling installations, having at least one sensor device having a sensor coil, which is fed with alternating current, in an electrical resonant circuit which is sensitive to an inductive interaction between the sensor coil and wheels rolling past on rail vehicles, and a further coil, which is connected in the opposite sense to the sensor coil in order to suppress external interference fields.

A wheel sensor such as this is known from the published German Patent Application DE 101 37 519 A1. In order to compensate for magnetic interference fields, the known wheel sensor has two coils with substantially the same geometry and the same numbers of turns, with the coils overlapping in the rail longitudinal direction with respect to a wheel sensor fitted to the rail, and being connected in opposite senses. This means that the two coils produce magnetic fields in opposite senses, when the same current is passed through them, thus also inducing voltages in opposite senses. Because of their arrangement, both coils are involved in the wheel detection process and, in the case of an interference field caused, for example, by a rail current, have magnetic alternating fields of substantially the same magnitude passing through them, which are therefore compensated for by the coils being connected in opposite senses.

BRIEF SUMMARY OF THE INVENTION

The present invention is based on the object of specifying an alternative or further wheel sensor of the type mentioned above, with particularly good interference suppression.

According to the invention, this object is achieved by a wheel sensor, in particular for track-free signaling installations, having at least one sensor device having a sensor coil, which is fed with alternating current, in an electrical resonant circuit which is sensitive to an inductive interaction between the sensor coil and wheels rolling past on rail vehicles, and a further coil, which is connected in the opposite sense to the sensor coil in order to suppress external interference fields, wherein the further coil is arranged under the sensor coil, and the distance between the further coil and the sensor coil is at least one third of the internal diameter of the sensor coil.

According to the invention, the further coil of the wheel sensor is therefore arranged under the sensor coil, with the distance between the further coil and the sensor coil being at least one third of the internal diameter of the sensor coil. In this case, the term "under" relating to the arrangement of the further coil with respect to the sensor coil relates to the alignment of a wheel sensor which is fitted correctly in the rail area. In this case, the sensor coil is normally arranged under an upper housing wall of the wheel sensor, such that the magnetic field of the sensor coil is damped by a wheel rolling or traveling past on a rail vehicle. This means that the longitudinal axis of the sensor coil is normally substantially at right angles to the rail longitudinal direction. As a fundamental distinction from the wheel sensor known from DE 101 37 519 A1, the further coil for the wheel sensor according to the invention is now, however, nor offset laterally, arranged overlapping the sensor coil, but under the sensor coil. In this case, it is of noted importance for the functionality of an arrangement such as this that the distance between the further coil and the sensor coil is at least one third of the internal diameter of the sensor coil since, otherwise, there will be no guarantee that the sensor coil will be sufficiently sensitive to wheels rolling past. This is a result of the fact that, if the distance between coils located one above the other were to be shorter, the mutual induction resulting from this would also result in virtually complete compensation even in the event of damping caused by a wheel traveling past, as a result of which it would no longer be possible to detect the wheel.

Since the further coil is arranged under the sensor coil and, at the same time, the distance between the further coil and the sensor coil is at least one third of the internal diameter of the sensor coil, this now, however, advantageously ensures that the further coil acts as a compensation coil, that is to say that it is used substantially only to compensate for interference fields, in particular from rail currents. This is because the further coil is further away from a wheel or wheel flange to be detected and, in consequence, its magnetic field is not influenced, or is influenced only to a comparatively minor extent, by the mass of iron rolling past. In contrast, the magnetic field surrounding the rail caused by a rail current flows through both coils, that is to say the sensor coil and the further coil, with opposite senses, and is therefore at least largely compensated for. Furthermore, interference from other sources is also advantageously compensated for by the arrangement of the coils in the wheel sensor. This relates, for example, to interference caused by power cables running in the vicinity of the sensor, or to possible interference effects from adjacent sensors.

Furthermore, the wheel sensor according to the invention has the advantage that the arrangement of the coils one above the other means that the housing length of the wheel sensor in the rail longitudinal direction can be utilized completely for each of the coils, that is to say both for the sensor coil and for the further coil. This allows the wheel rolling past to act over a particularly great length, thus resulting in the wheel sensor being particularly highly sensitive. This also applies in particular in the event of a lateral offset of the mass of iron to be detected caused by wheel flanges worn to different extents.

The wheel sensor according to the invention is preferably designed such that the further coil is arranged such that its longitudinal axis runs parallel to that of the sensor coil. Since the turn planes of the sensor coil and of the further coil are in this case parallel, or at least substantially parallel, to one another, this results in particularly good compensation for interference fields.

In a further particularly preferred embodiment, the wheel sensor according to the invention is designed such that the further coil is arranged such that its longitudinal axis corresponds to that of the sensor coil. This means that the longitudinal axes of the further coil and of the sensor coil coincide, that is to say that the two coils are arranged centrally one above the other. This is preferable since this allows the best-possible compensation for the resultant magnetic interference field or the resultant interference voltage induced by the magnetic interference field, in particular for rail currents, which produce a field which is symmetrical with respect to the rail.

In principle, it is feasible for the sensor coil to have a core. However, particularly in order to prevent interference resulting from magnetic saturation effects, it is advantageous for the wheel sensor according to the invention to be designed such that the sensor soil is an air-cored coil.

In a corresponding manner to the above statements, with respect to the further coil, an embodiment of the wheel sensor according to the invention is also preferred in which the further coil is an air-cored coil.

In principle, the sensor coil and the further coil may be coils of the same type. In a further preferred embodiment of the wheel sensor according to the invention, the further coil is of a different type to the sensor coil, in particular with respect to its geometry and/or its number of turns. This is advantageous because the magnetic field created by a rail current is normally dependent on height, because of the rail geometry. Depending on the respective circumstances, and in particular depending on the respective existing rail profile, it is therefore advantageous if the further coil is of a different type to the sensor coil, in particular with respect to its geometry and/or its number of turns, since this allows optimum compensation for interference variables.

The wheel sensor according to the invention can preferably also be designed such that at least two sensor devices are provided, which are at a distance from one another in the rail longitudinal direction, with respect to a wheel sensor which is fitted in the rail area. This offers the advantage that the direction of travel of the wheel rolling past can be determined by means of the at least two sensor devices, which each have a sensor coil and a further coil. In the case of a normal two-channel wheel sensor such as this, which therefore has two sensor devices, the two sensor devices or sensor channels produce signals which are offset in time successively when a wheel of a rail vehicle travels past, and these signals can be used in a downstream evaluation unit to identify the direction of travel of the rail vehicle.

The invention will be explained in more detail in the following text with reference to exemplary embodiments. For this purpose,

DESCRIPTION OF THE INVENTION

Figure 1:
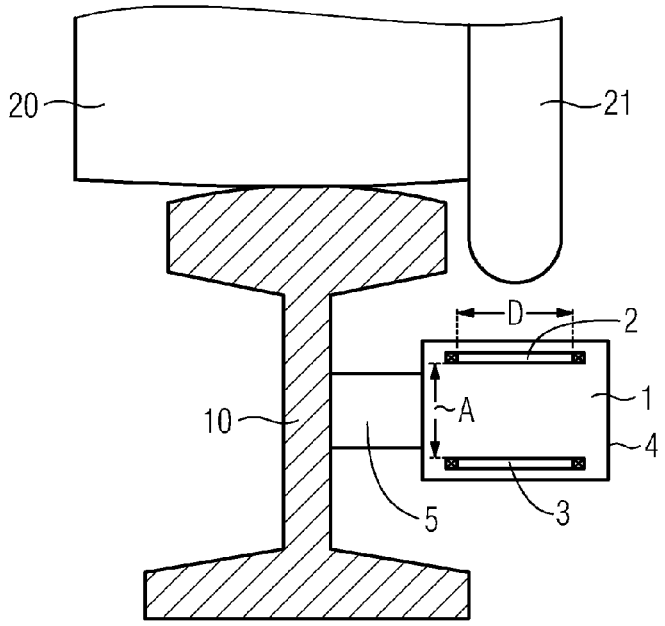
FIG. 1 shows a schematic sectional illustration of a first exemplary embodiment of a wheel sensor according to the invention fitted to the rail.

FIG. 1 shows a schematic sectional illustration of a first exemplary embodiment of a wheel sensor according to the invention fitted to the rail. The illustration is in the form of a section at right angles to the rail longitudinal direction and shows a wheel sensor 1 which has a sensor coil 2 and a further coil 3. The sensor coil 2 and the further coil are arranged in a housing 4 of the wheel sensor 1, with the wheel sensor 1, to be precise the housing 4 of the wheel sensor 1, being attached to a rail 10 by attachment means 5.

The sensor coil 2 is fed with an alternating current and is a component of a resonant circuit, which is sensitive to inductive interaction between the sensor coil 2 and wheels rolling past. Furthermore, the sensor coil 2 is connected in the opposite sense to the further coil 3 in order to suppress interference fields. For clarity reasons, neither the electrical components or connections mentioned above nor further components, known per se, of the wheel sensor 1 have been illustrated in FIG. 1. This relates, for example, to a monitoring or evaluation circuit which may be provided in the wheel sensor 1, as well as cable runs from and to the wheel sensor 1.

FIG. 1 shows the wheel sensor 1 in its position on the rail when a wheel 20, which has a wheel flange 21, is travelling past. As shown in the illustration in FIG. 1, the sensor coil 2 of the wheel sensor 1 is positioned on the rail 10 such that the field of the sensor coil 2 is damped or attenuated by the wheel flange 21 of the wheel 20.

As can be seen from FIG. 1, the further coil 3 is arranged under the sensor coil 2 with respect to a wheel sensor 1 which is fitted to or mounted on the rail. In this case, the distance A between the sensor coil 2 and the further coil 3 is at least one third of the internal diameter D of the sensor coil 2. This ensures that the influence of the further coil 3 on wheel detection is sufficiently small to prevent a reduction in the sensitivity or the functionality of the wheel sensor 1 to wheels 2 or flanges 21 of wheels 20 to be detected, which would otherwise be caused by the connection of the sensor coil 2 and the further coil 3 in opposite senses. This means that the further coil 3 makes substantially no contribution to wheel detection but is used at least mainly to compensate for interference fields, in particular for rail current compensation.

As can be seen in the exemplary embodiment in FIG. 1, the further coil 3 is arranged such that its longitudinal axis coincides with that of the sensor coil 2. Furthermore, in the illustrated exemplary embodiment, both the sensor coil 2 and the further coil 3 are air-cored coils, thus avoiding problems which can occur because of saturation effects in the case of coils with iron cores.

In contrast to the illustration in FIG. 1, an embodiment is also feasible in which the sensor coil 2 and the further coil 3 are of different types, that is to say in particular they have different geometries and/or numbers of turns. This can advantageously be used to achieve optimum interference field compensation, depending on the respective rail profile. The background in this case is that, for example, the magnetic field caused by a rail current is generally not independent of height, because of the rail geometry, as a result of which the voltage induced in the sensor coil 2 when using coils of the same type will normally differ from the voltage induced in the further coil 3.

Figure 2:
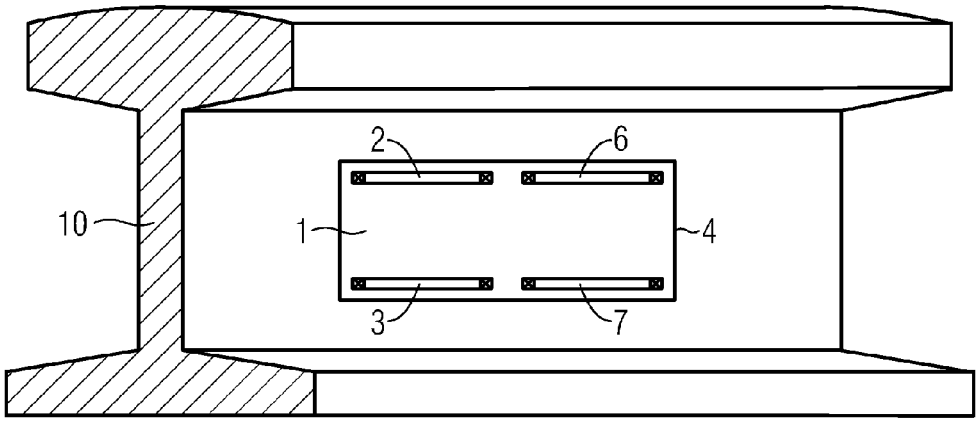
FIG. 2 shows a perspective side view of a second exemplary embodiment, fitted to a rail, of a wheel sensor according to the invention having two sensor devices.

FIG. 2 shows a perspective side view of a second exemplary embodiment, fitted to a rail, of a wheel sensor according to the invention having two sensor devices. In this case, those components which are identical to or have substantially the same function as the components illustrated in FIG. 1 are annotated with the same reference symbols.

As can be seen from the side view in FIG. 2, the illustrated wheel sensor 1 has two sensor coils 2 and 6 as well as two further coils 3 and 7, which are accommodated in the housing 4 of the wheel sensor 1. In this case, the coils 2 and 3 and the coils 6 and 7 are each a component of a sensor device, that is to say the illustrated wheel sensor 1 has two sensor devices. In this case, the respective sensor coil 2 or 6 of the respective sensor device is connected to the respective further coil 3 or 7 of the respective sensor device in opposite senses, thus compensating for interference fields.

Since the wheel sensor 1 has two sensor devices, it is possible on the basis of time correlation between the signals detected by the sensor devices to determine the direction of travel of a wheel rolling past, or of a rail vehicle rolling past. Because of this, the illustrated wheel sensor is particularly suitable for use for track-free signaling installation purposes.

In a corresponding manner to the exemplary embodiments described above, the wheel sensor 1 has the advantage that externally induced interference influences are largely suppressed, since these substantially equally influence both the sensor coil 2 or 6 and the further coil 3 or 7. In particular, these include rail currents, since the input symmetry is particularly high in this case. However, interference variables from other sources can also advantageously be compensated for. In this case, the arrangement of the coils of a sensor device one above the other advantageously makes it possible, in an embodiment with only one sensor device for each of the coils, that is to say for example both for the sensor coil 2 and for the further coil 3, to utilize the complete length of the housing 4 in the rail longitudinal direction. This results in a particularly long length of influence, linked to high sensitivity both in the rail longitudinal direction and at right angles to the rail longitudinal direction. Conversely, the wheel sensor according to the invention also makes it possible, however, to provide a particularly compact physical form, that is to say a particularly short housing length in the rail longitudinal direction. This is advantageous in particular in situations in which the space available adjacent to the rail is restricted.

The invention claimed is:

1. A wheel sensor with at least one sensor device, comprising:

a sensor coil, operating on alternating current, connected in an electrical resonant circuit that is sensitive to an inductive interaction between said sensor coil and a rail vehicle wheel rolling past said sensor coil, said sensor coil having an internal diameter; and a further coil disposed underneath said sensor coil, connected in an opposite sense to said sensor coil, and operative to suppress external interference fields;

said further coil being disposed at a spacing distance from said sensor coil, said spacing distance amounting to at least one third of said internal diameter of said sensor coil;

said further coil having a longitudinal axis extending coaxially with said sensor coil.

2. The wheel sensor according to claim 1 in combination with a track-free signaling installation.

3. The wheel sensor according to claim 1, wherein said further coil has a longitudinal axis extending parallel to a longitudinal axis of said sensor coil.

4. The wheel sensor according to claim 1, wherein said sensor coil is an air-cored coil.

5. The wheel sensor according to claim 1, wherein said further coil is an air-cored coil.

6. The wheel sensor according to claim 1, wherein said further coil and said sensor coil are of a mutually different type.

7. The wheel sensor according to claim 6, wherein said further coil and said sensor coil have mutually different geometry.

8. The wheel sensor according to claim 6, wherein said further coil and said sensor coil have a mutually different number of turns.

9. The wheel sensor according to claim 1, comprising at least two sensor devices disposed at a distance from one another along a longitudinal direction of a rail, with respect to a wheel sensor mounted in a region of the rail.

* * * * *